US005150689A

United States Patent [19]

Yano et al.

[11] Patent Number: 5,150,689

[45] Date of Patent: Sep. 29, 1992

[54] FUEL TANK VAPOR CONTROL SYSTEM WITH MEANS FOR WARNING OF MALFUNCTION OF CANISTER

[75] Inventors: Hirofumi Yano, Yokohama; Seiji Yokoi, Tokyo, both of Japan

[73] Assignee: Nissan Motor Co., Ltd., Yokohama, Japan

[21] Appl. No.: 758,911

[22] Filed: Sep. 12, 1991

[30] Foreign Application Priority Data

Sep. 14, 1990 [JP] Japan ..... 2-244687

[51] Int. Cl.[5] ..... F02M 33/02

[52] U.S. Cl. ..... 123/519; 123/520; 123/198 D; 123/494; 123/518

[58] Field of Search ..... 123/494, 479, 516, 518, 123/519, 520, 521, 198 D

[56] References Cited

U.S. PATENT DOCUMENTS

| | | | |
|---|---|---|---|
| 4,176,639 | 12/1979 | Shinoda et al. | 123/520 |
| 4,343,281 | 8/1982 | Uozumi et al. | 123/519 |
| 4,846,135 | 7/1989 | Tiphaine | 123/518 |
| 4,949,695 | 8/1990 | Uranishi et al. | 123/494 |
| 4,962,744 | 10/1990 | Uranishi et al. | 123/520 |
| 5,088,466 | 2/1992 | Tada | 123/519 |
| 5,099,439 | 3/1992 | Saito | 123/520 |

FOREIGN PATENT DOCUMENTS 58-148259 9/1983 Japan .

*Primary Examiner*—E. Rollins Cross
*Assistant Examiner*—Thomas N. Moulis
*Attorney, Agent, or Firm*—Foley & Lardner

[57] ABSTRACT

A fuel tank vapor control system is provided with an improved device for warning of malfunction of a canister. The device judges on malfunction of the canister on the basis of whether opening of a purge passage is effective for causing an inside temperature fall of the canister. In order to prevent an erroneous judgement on malfunction of the canister on the basis of an overflow condition of the canister, a purge passage is first closed so that the canister fully adsorbs hydrocarbon vapors from a fuel tank and then opened so that an inside temperature fall of the canister occurs. Opening and closing of the purge passage is repeated for several times so that a reliable judgement on malfunction of the canister is formed after lapse of a certain time and under a different operating condition of the canister.

8 Claims, 5 Drawing Sheets

FUEL TANK VAPOR CONTROL SYSTEM WITH MEANS FOR WARNING OF MALFUNCTION OF CANISTER

BACKGROUND OF THE INVENTION

1. Field of the Invention

The present invention relates in general to a fuel tank vapor control system for an automotive vehicle and more particularly to a means for warning of malfunction of a canister in a fuel tank vapor control system.

2. Description of the Prior Art

As is well known, a fuel tank vapor control system for emission control of an automotive vehicle, includes a canister of activated charcoal, which is connected to a fuel tank and adsorbs or traps evaporative hydrocarbons or hydrocarbon vapors from the fuel tank for thereby preventing them from escaping to the atmosphere (refer to Japanese Patent Provisional Publication No. 58-148259).

However, the canister has a possibility of malfunctioning and becoming incapable of trapping the hydrocarbon vapors from the fuel tank or feeding them back into the engine. For this reason, a device for monitoring the operating condition of the canister has been required.

An example of such a device includes a temperature sensor installed on the canister for detecting a temperature rise and temperature fall of the canister resulting from adsorption and regeneration of the hydrocarbon vapors and is adapted to judge that the canister is malfunctioning when such a temperature fall cannot be detected.

However, in the event of a high-load engine operating condition in which an associated vehicle is, for example, climbing an uphill under an atmospheric temperature condition of 30° C., a quantity of hydrocarbon vapors supplied from the fuel tank to the canister increases sharply to cause the canister to be put into an overflow condition in which a flow rate of the hydrocarbon vapors supplied from the fuel tank to the canister (i.e., charge flow rate) is larger than a flow rate of the hydrocarbon vapors regenerating or coming away from the canister (i.e., purge flow rate). Under this overflow condition, the weight of the contents of the canister (i.e. weight of hydrocarbonlaiden charcoal) is maintained substantially unchanged, i.e., in an equilibrium state while at the same time the inside temperature of the canister (i.e., temperature of charcoal) is maintained substantially unchanged, i.e., in an equilibrium state. Due to this, with the prior art device, such an overflow condition is erroneously judged as malfunction of the canister.

On the contrary, when the charge flow rate is so small, a variation of the inside temperature of the canister does not almost occur even when the canister is functioning properly. With the prior art device, such a small charge rate condition is also judged as malfunction of the canister.

SUMMARY OF THE INVENTION

In accordance with the present invention, there is provided an improved and novel fuel tank vapor control system for an automotive vehicle, which comprises a fuel tank with hydrocarbon vapors, a canister for adsorbing the hydrocarbon vapors from the fuel tank, engine induction passage means, purge passage means for supplying the hydrocarbon vapors regenerating from the canister to the engine induction passage means, valve means for selectively opening and closing the purge passage means, temperature sensor means for detecting an inside temperature of the canister, judgement suspending means for suspending a judgement on malfunction of the canister when opening of the purge passage means is ineffective for causing an inside temperature fall of the canister, and once closing the purge passage means so that the canister fully adsorbs the hydrocarbon vapors, and malfunction judging means for judging that the canister is malfunctioning when opening of the purge passage after the closing thereof by the malfunction suspending means is still ineffective for causing an inside temperature fall of the canister.

The above structure is effective for solving the above noted problems inherent in the prior art system.

It is accordingly an object of the present invention to provide a novel and improved fuel tank vapor control system for an automotive vehicle which can assuredly prevent an erroneous judgement on malfunction of the canister on the basis of an overflow condition of the canister.

It is another object of the present invention to provide a novel and improved fuel tank vapor control system of the above described character which can improve the accuracy and reliability of a judgement on malfunction of the canister.

It is a further object of the present invention to provide a novel and improved fuel tank vapor control system of the above described character which can put the canister into a different operating condition other than an overflow condition when forming a judgement on malfunction of the canister.

It is a further object of the present invention to provide a novel and improved fuel tank vapor control system of the above described character which can form a reliable judgement on an overflow condition of the canister.

It is a further object of the present invention to provide a novel and improved fuel tank vapor control system of the above described character which is useful for air pollution control.

DETAILED DESCRIPTION OF THE PREFERRED EMBODIMENTS

Figure 1:
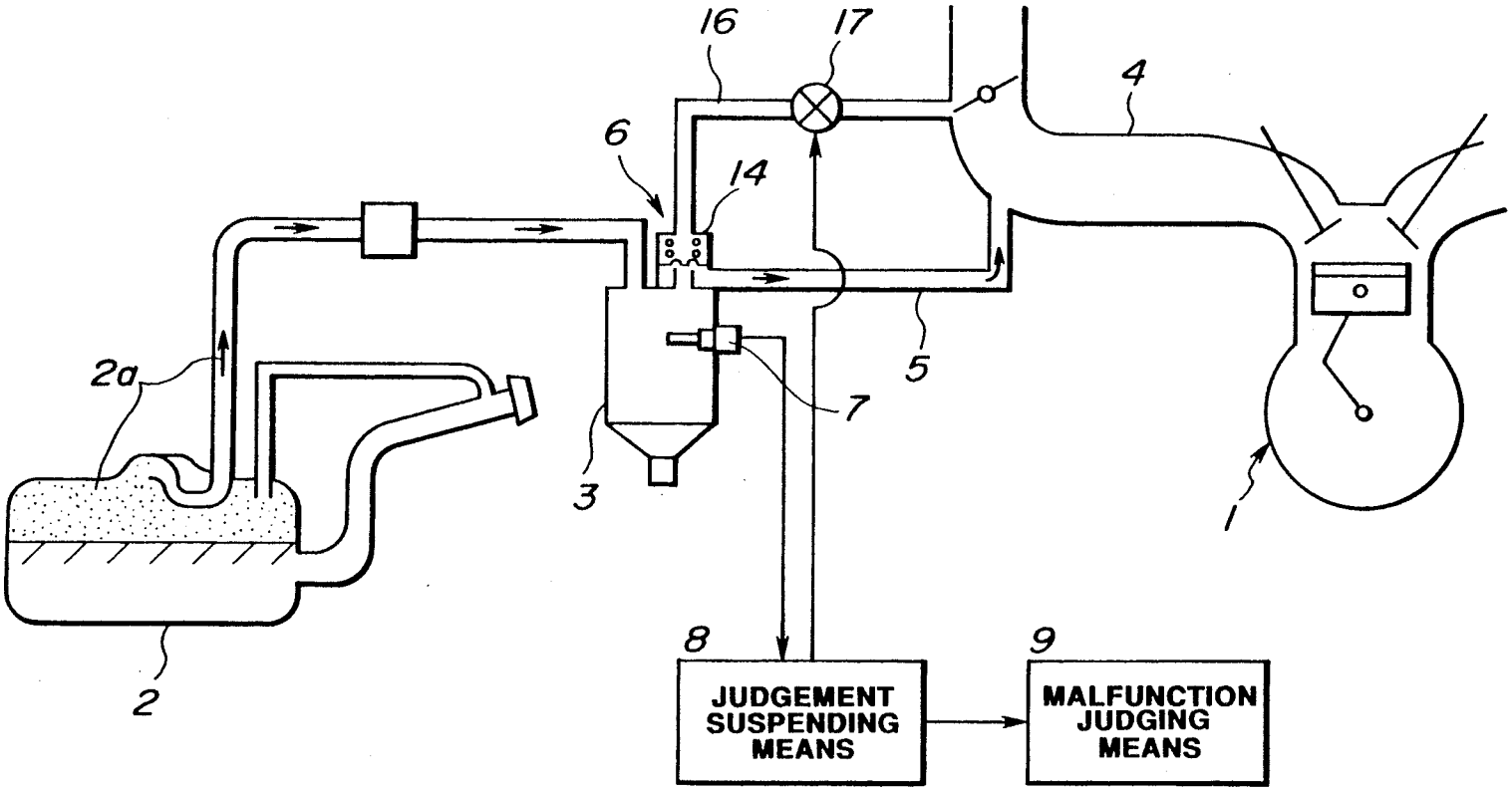
FIG. 1 is a diagrammatic view of a fuel tank vapor control system with means for warning of malfunction of a canister according to an embodiment of the present invention.
Figure 2:
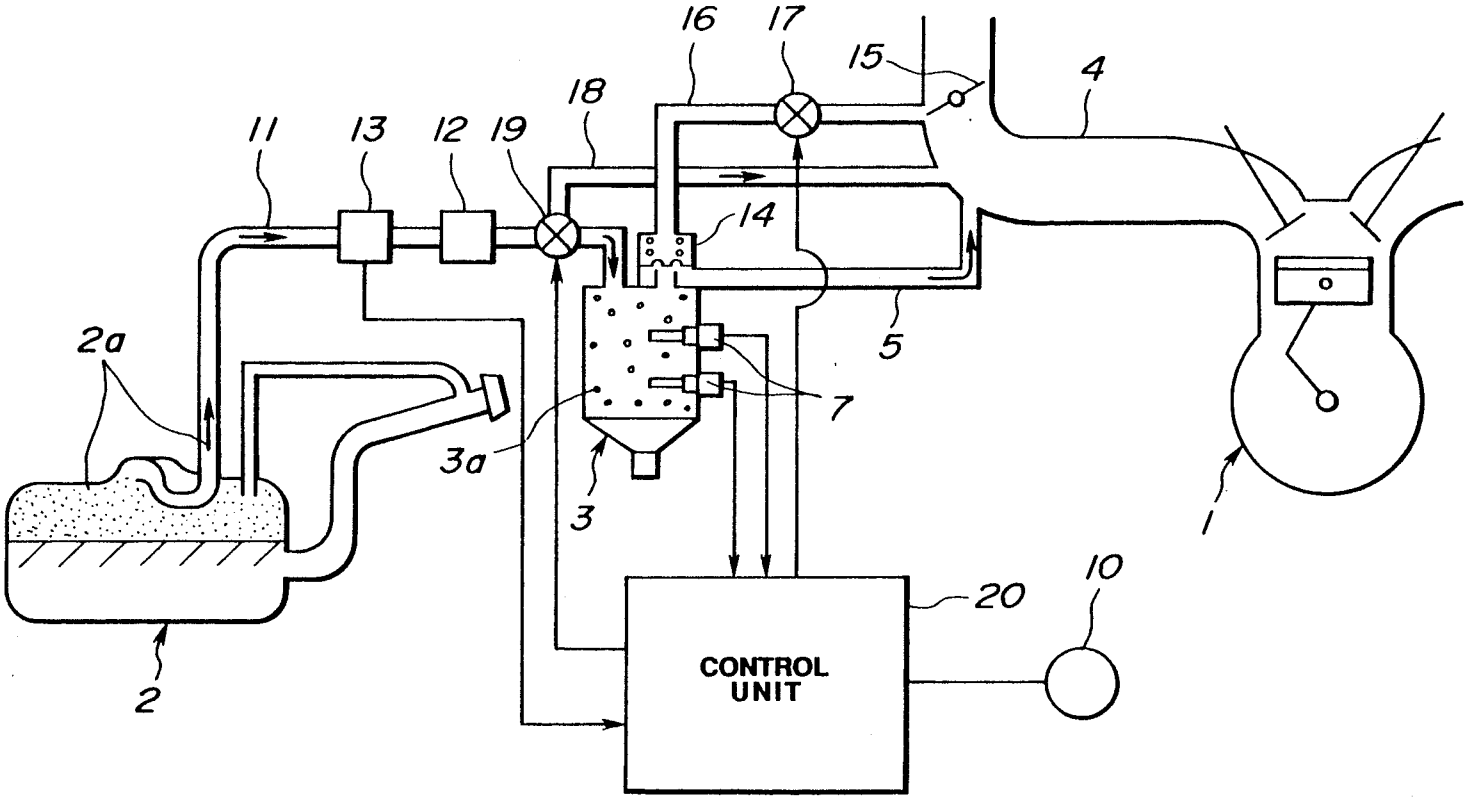
FIG. 2 is a view similar to FIG. 1 but shows another embodiment of the present invention.

Referring first to FIG. 1, a fuel tank vapor control system is shown as comprising a canister 3 for adsorbing the hydrocarbon vapors 2*a* from the fuel tank 2, a purge passage 5 for providing communication between the canister 3 and an induction passage 4 of an engine 1 for supplying the hydrocarbon vapors regenerating or coming away from the canister 3 to the induction passage 4, valve means 6 for controlling opening and closing of the purge passage 5 and thereby controlling communication between the canister 3 and the induction passage 4, a temperature sensor 7 for detecting an inside temperature of the canister 3, judgement suspending means 8 for suspending a judgement on malfunction of the canister 3 when opening of the purge passage is ineffective for causing an inside temperature fall of the canister 3, and once closing the purge passage 5 so that the canister 3 fully adsorbs the hydrocarbon vapors 2*a*, and malfunction judging means 9 for judging that the canister 3 is malfunctioning when opening of the purge passage 5 after the above described closing thereof by the malfunction suspending means 8 is still ineffective for causing an inside temperature fall of the canister 3.

The valve means 6 comprises a purge control valve 14 provided to the purge passage 5 for opening and closing the same in response to a vacuum supplied thereto, a vacuum passage 16 interconnecting the induction passage 4 and the purge control valve 14 for supplying a vacuum produced in the induction passage 4 to the purge control valve 14, and a purge cut valve 17 for opening and closing the vacuum passage 16 for thereby controlling supply of the vacuum to the purge control valve 14.

With the fuel tank vapor control system, when the engine 1 is operated under a high-load condition of causing the flow rate of the hydrocarbon vapors supplied from the fuel tank 2 to the canister 3 (i.e., charge flow rate) to become larger than the flow rate of the hydrocarbon vapors regenerating or coming away from the canister 3 (i.e., purge flow rate) for thereby putting the canister 3 into an overflow condition in which a substantial temperature fall of the canister 3 does not occur even with the purge passage 5 being opened, a judgement on malfunction of the canister 3 is formed once again with some delay and under a different engine operating condition, thus making it possible to prevent an erroneous judgement on malfunction of the canister 3 on the basis of its overflow condition. When the charge flow rate is so small, the purge passage 5 is similarly closed in order to form a judgement on malfunction of the canister 3 with some delay and under a different engine operating condition.

Referring to FIGS. 2 to 5, a fuel tank vapor control system according to another embodiment of the present invention includes a charge passage 11 for supplying the hydrocarbon vapors from a fuel tank 2 to a canister 3, and a purge passage 5 for supplying the hydrocarbon vapors regenerating or coming away from the canister 3 to an induction passage 4 of an engine 1.

An end of the purge passage 5 is connected to the induction passage 4 at a location downstream of a throttle valve 15. A purge control valve 14 is provided to the purge passage 5 and operable to open the purge passage 5 by means of a vacuum produced adjacent the throttle valve 15 and introduced to the purge control valve 14 through a vacuum passage 16. The vacuum passage 16 is provided with a purge cut valve 17 for controlling communication between the induction passage 4 and the purge control valve 14 through the vacuum passage 16. When the purge cut valve 17 shuts off or closes the vacuum passage 16 for thereby preventing supply of a vacuum from the induction passage 4 to the purge control valve 14, the purge control valve 14 is held closed.

The charge passage 11 is provided with a check valve (one-way valve) 12 and a pressure sensor 13 at a location downstream of the check valve 12, i.e., at a location nearer to the fuel tank 2 than the check valve 12.

A bypass passage 18 is provided for interconnecting the charge passage 11 and the induction passage 4 while bypassing the canister 3. The bypass passage 18 is connected through a shut-off valve 19 to the canister 3, which shut-off valve 19 is selectively movable into a position where it closes the charge passage 11 while opening the bypass passage 18 and a position where it opens the charge passage 11 while closing the bypass passage 18.

The canister 3 is provided with a pair of upper and lower temperature sensors 7 for detecting the temperature of the charcoal 3*a* installed in the canister 3 (i.e., inside temperature of canister 3) and supply signals representative thereof to a control unit 20. The control unit 20 judges whether the canister 3 is functioning properly on the basis of a temperature rise resulting from adsorption of the hydrocarbon vapors by the charcoal 3*a* of the canister 3 and a temperature fall resulting from regeneration or removal of the hydrocarbon vapors from the charcoal 3*a* of the canister 3. When the inside temperature the canister 3 does not fall after opening of the purge passage 5, i.e., opening of the canister 3 is ineffective for causing an inside temperature fall of the canister 3, the canister 3 is first judged to be in an overflow condition in which a large quantity of hydrocarbon vapors from the fuel tank 2 is charged to the canister 3 or in a condition in which a so small quantity of hydrocarbon vapors is charged to the canister 3. In this instance, the purge passage 5 is once closed so that the hydrocarbon vapors is fully adsorbed by the canister 3, and it is delayed to form a judgement on malfunction of the canister 3. Thereafter, the purge passage 5 is opened again to allow the hydrocarbon vapors regenerating from the canister 3 to be fed into the induction passage 4. When, however, an inside temperature fall of the canister 3 still does not occur, i.e., opening of the purge passage 5 for a second time is still ineffective for causing an inside temperature fall of the canister 3, the canister 3 is judged to be malfunctioning. When the canister 3 is judged to be malfunctioning, the warning lamp 10 is lit to inform a driver of the malfunction.

The control processings executed by the control unit 20 will be described more in detail with reference to the flowcharts of FIGS. 3 to 5.

Figure 3:
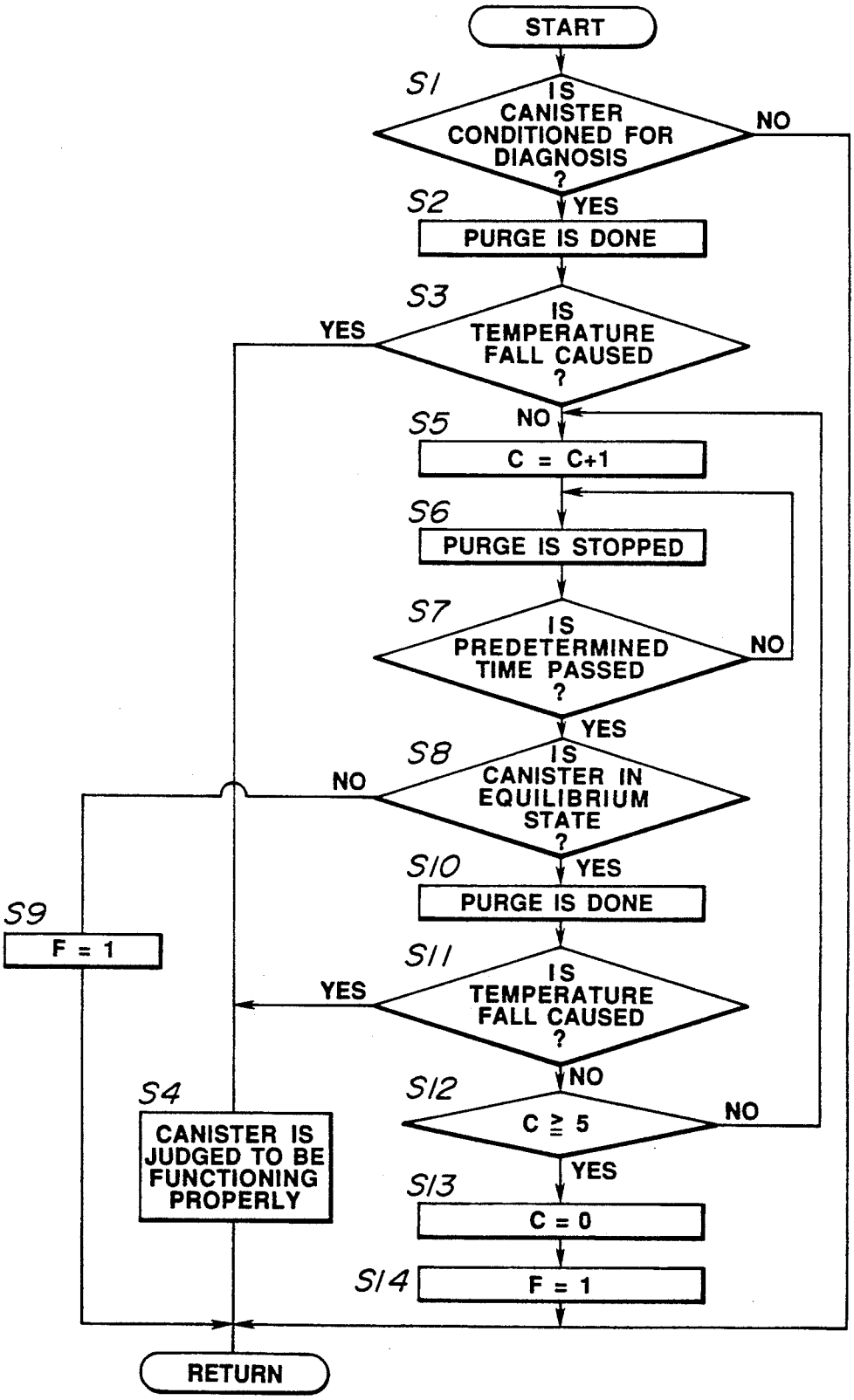
FIGS. 3 to 5 are flowcharts of control routines performed by the fuel vapor control system of FIG. 1.

Referring first to FIG. 3, when the canister 3 is conditioned for diagnosis, the purge cut valve 17 is opened for thereby opening the purge passage 5. The inside temperature of the canister 3 is detected by the temperature sensors 7, so that when an inside temperature fall of the canister 3 occurs, i.e., opening of the purge passage 5 is effective for causing an inside temperature fall of the canister 3, the canister 3 is judged to be functioning properly (S1, S2, S3 and S4).

On the other hand, when an inside temperature fall of the canister 3 does not occur, i.e., opening of the purge passage 5 is ineffective for causing an inside temperature fall of the canister 3, the purge cut valve 17 is once closed so the the canister 3 fully adsorbs the hydrocarbon vapors, since the canister 3 is considered to be either malfunctioning or in an overflow condition in which the charge flow rate is larger than the purge flow rate. After lapse of a predetermined time, the canister 3 comes to fully adsorb the hydrocarbon vapors, thus causing the inside temperature of the canister 3 to be held substantially unchanged, i.e., in an equilibrium state. The purge passage 5 is opened again by means of the purge cut valve 17, and it is detected by the temperature sensors 7 whether an inside temperature fall of the canister 3 occurs (S5, S6, S7, S8, S10 and S11). The above routine is repeated for five times maximally unless an inside temperature fall of the canister 3 occurs.

In the event that an inside temperature fall of the canister 3 is recognized during repetition of the above routine for five times, the canister 3 is judged to be functioning properly (S11, S 4). On the other hand, in the event that an inside temperature fall is not recognized, the canister 3 is judged to be malfunctioning, and a flag F=1 is set to indicate the malfunction and finish the routine (S12, S13, 14).

When the canister 3 is in an overflow condition due to, for example, an uphill climbing of a vehicle, a vehicle travelling condition will vary during the above repetition of the routine, thus causing the canister 3 to be put out of the overflow condition for thereby making it possible to judge whether the canister 3 is functioning properly under a different operating condition, and thus making it possible to prevent an erroneous judgement on malfunction of the canister 3 on the basis of the overflow condition.

Figure 4:
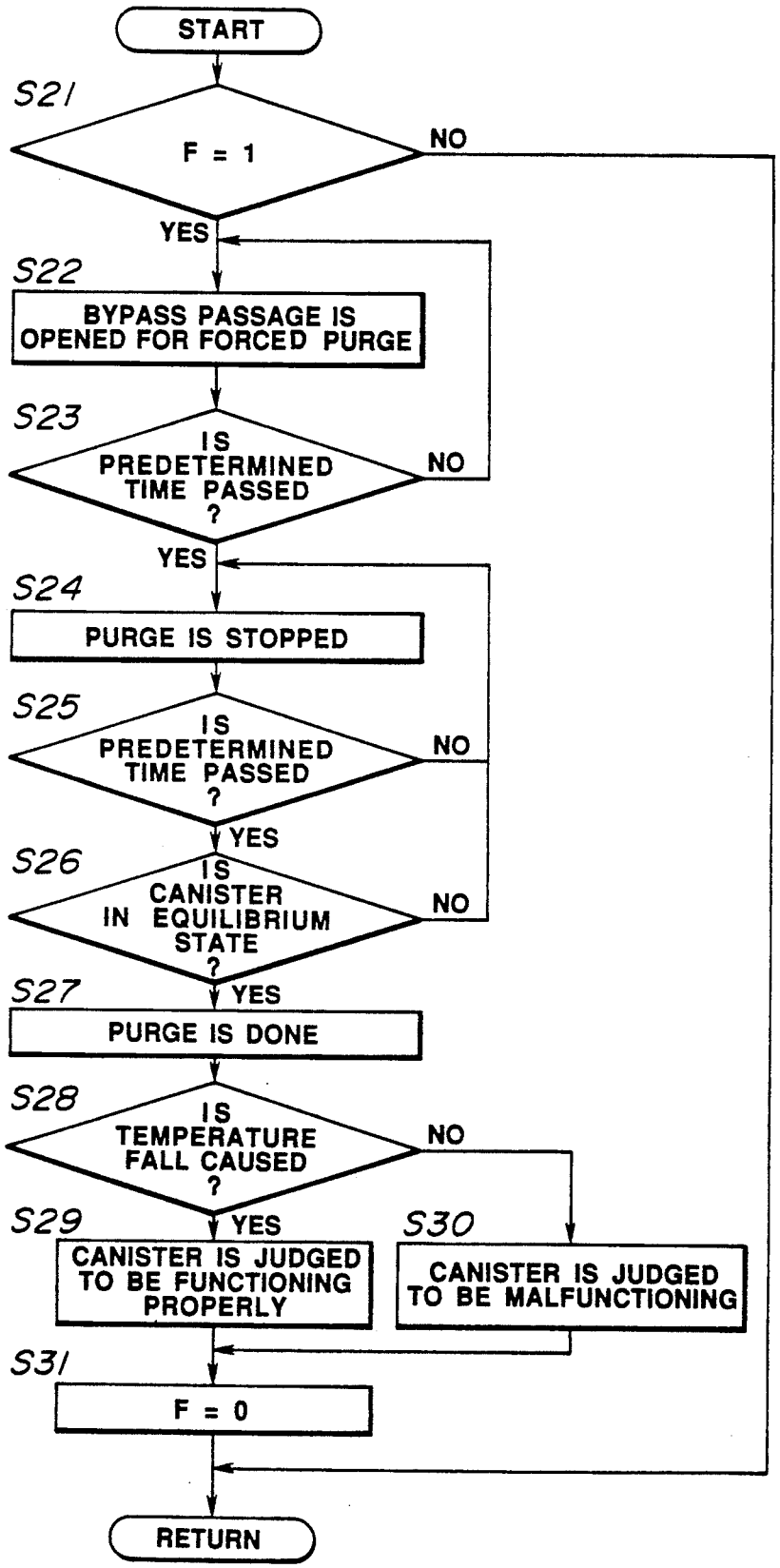

Then, in the event that the canister 3 cannot be recognized as being functioning properly, the diagnosis routine proceeds to that shown in FIG. 4, to cause the purge cut valve 17 to be opened for thereby opening the purge passage 5 so that the hydrocarbon vapors adsorbed by the canister 3 is removed or stripped off therefrom, while causing the shut-off valve 19 to be moved into a position where it opens the bypass passage 18 (S21, S22). By this, supply of the hydrocarbon vapors to the canister 3 is stopped, and the hydrocarbon vapors adsorbed by the canister 3 is introduced through the purge passage 5 into the induction passage 4 for thereby causing the quantity of hydrocarbon vapors stored by the canister 3 to be reduced and finally causing the canister 3 to be put into an incipient condition in which almost all of the hydrocarbon vapors are removed from the canister 3.

After the canister 3 is returned to its incipient condition in the above matter, the purge cut valve 17 is once closed so that the canister 3 fully adsorbs the hydrocarbon vapors. When the canister 3 is put into an equilibrium state, i e., in a state of its inside temperature being held substantially unchanged, the canister 3 is judged to have fully adsorbed the hydrocarbon vapors. The purge cut valve 17 is then opened again for detecting whether an inside temperature fall of the canister 3 occurs (S23, S24, S25, S26, S27, S28).

When an inside temperature fall of the canister 3 is recognized, the canister 3 is judged to be functioning properly (S23, S29). When an inside temperature fall is not recognized, the canister 3 is judged to be malfunctioning, thus causing the warning lamp 10 to be lit (S28, S30).

Further, it is possible to judge on the basis of a signal from the pressure sensor 13 whether the canister 3 is in the overflow condition. That is, as the check valve 12 is opened to allow an increasing amount of the hydrocarbon vapors in the fuel tank 2 to be supplied to the canister 3, the pressure in the charge passage 11 becomes higher. From the time integral from this pressure, it is possible to compute the flow rate of the hydrocarbon vapors in the charge passage 11.

Figure 5:
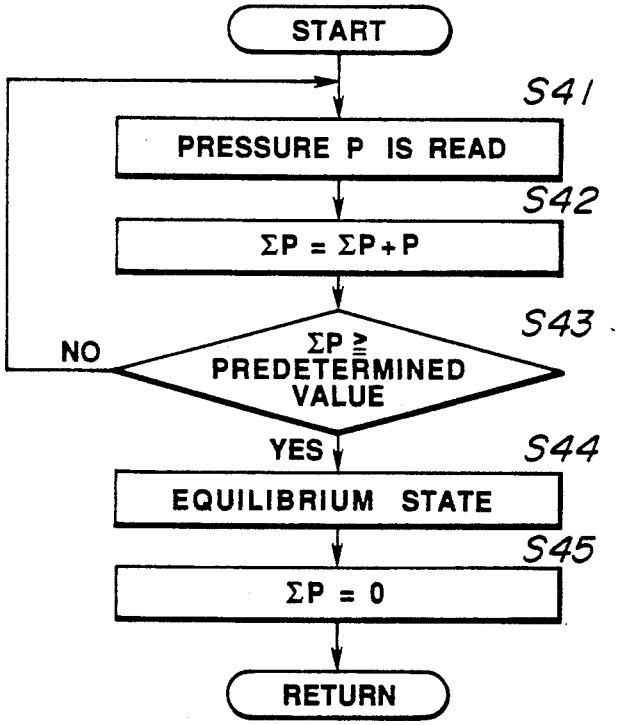

From this, as shown in FIG. 5, it is judged that when the time integral of the detected pressure P by the pressure sensor 13 exceeds a predetermined value the canister 3 is judged to be in an overflow condition or in an equilibrium state, i.e., in a state of its inside temperature being held substantially unchanged.

From the foregoing, it will be understood that when a canister, due to a high-load condition of an associated engine, is put into an overflow condition in which a flow rate of hydrocarbon vapors introduced to the canister (i.e., charge flow rate) is higher than a flow rate of hydrocarbon vapors regenerating from the canister (i.e., purge flow rate), a judgement on malfunction of the canister 3 is suspended so as to be formed again after lapse of a certain time and under a different engine operating condition, thus making it possible to prevent an erroneous judgement on malfunction of the canister 3 on the basis of the overflow condition and thereby make higher the accuracy and reliability of the judgement.

It will be further understood that under the overflow condition of the canister it becomes possible to cause a large amount of hydrocarbon vapors to be fed directly into the engine by opening the bypass passage while causing the hydrocarbon vapors fully adsorbed by the canister to be removed therefrom and fed into the engine, thus making it possible to attain an efficient anti-air pollution control and a correct judgement on malfunction of the canister.

It will be further understood that by disposing a pressure sensor in a charge passage at a location downstream of a check valve and by computing a purge flow rate it becomes possible to compute a quantity of hydrocarbon vapors stored by the canister and thereby correctly decide the overflow condition of the canister.

What is claimed is:

1. A fuel tank vapor control system for an automotive vehicle comprising:

a fuel tank with hydrocarbon vapors;

a canister for adsorbing the hydrocarbon vapors from said fuel tank;

engine induction passage means;

purge passage means for supplying the hydrocarbon vapors regenerating from said canister to said engine induction passage means;

valve means for selectively opening and closing said purge passage means;

temperature sensor means for detecting an inside temperature of said canister;

judgement suspending means for suspending a judgement on malfunction of said canister when opening of said purge passage means is ineffective for causing an inside temperature fall of said canister, and once closing said purge passage means so that said canister fully adsorbs the hydrocarbon vapors; and malfunction judging means for judging that said canister is malfunctioning when opening of said purge passage means after said closing thereof by said malfunction suspending means is still ineffective for causing an inside temperature fall of said canister.

2. A fuel tank vapor control system according to claim 1, wherein said valve means comprises purge control valve means provided to said purge passage means for opening and closing the same in response to a vacuum supplied thereto, vacuum passage means interconnecting said purge control valve means and said engine induction passage means for introducing said vacuum to said purge control valve means, and purge cut valve means provided to said vacuum passage means for controlling supply of said vacuum to said purge control valve means.

3. A fuel tank vapor control system for an automotive vehicle, comprising:

a fuel tank with hydrocarbon vapors;

a canister for adsorbing the hydrocarbon vapors from said fuel tank;

engine induction passage means;

purge passage means for supplying the hydrocarbon vapors regenerating from said canister to said engine induction passage means;

valve means for selectively opening and closing said purge passage means;

temperature sensor means for detecting an inside temperature of said canister and producing a signal representative thereof; and control means for controlling opening and closing of said purge passage means in response to the signal from said temperature sensor means, said control means having judgement suspending means for suspending a judgement on malfunction of said canister when opening of said purge passage means is ineffective for causing an inside temperature fall of said canister, and once closing said purge passage means so that said canister fully adsorbs the hydrocarbon vapors, and malfunction judging means for judging that said canister is malfunctioning when opening of said purge passage means after said closing thereof by said malfunction suspending means is still ineffective for causing an inside temperature fall of said canister.

4. A fuel tank vapor control system according to claim 3, wherein said valve means comprises purge control valve means for opening and closing the same in response to a vacuum supplied thereto, vacuum passage means interconnecting said purge control valve means and said engine induction passage for introducing said vacuum to said purge control valve means, and purge cut valve means provided to said vacuum passage means for controlling supply of said vacuum to said purge control valve means.

5. A fuel tank vapor control system according to claim 4, further comprising charge passage means for supplying the hydrocarbon vapors from said fuel tank to said canister, check valve means provided to said charge passage means for preventing flow of the hydrocarbon vapors therethrough toward said fuel tank, and pressure sensor means provided to said charge passage means at a location nearer to said fuel tank than said check valve means, for detecting a pressure inside of said charge passage means and producing a signal representative thereof, said control means further comprising computing means for computing a flow rate of the hydrocarbon vapors to be supplied to said canister on the basis of the signal from said pressure sensor means.

6. A fuel tank vapor control system according to claim 5, further comprising bypass passage means for providing communication between said charge passage means and said engine induction passage means while bypassing said canister, and shut-off valve means selectively movable into a first position where it opens said bypass passage means while closing said charge passage means and a second position where it closes said bypass passage means while opening said charge passage means, said control means further having means for moving said shut-off valve means into said first position while causing said purge passage to open for thereby allowing almost all of the hydrocarbon vapors adsorbed by said canister to be removed therefrom.

7. A fuel tank vapor control system according to claim 6, wherein said control means further having means for repeatedly using said judgement suspending means for a plurality of times before using said malfunction judging means.

8. A fuel tank vapor control system according to claim 7, wherein said control means further comprises means for causing a warning lamp to be lit when said malfunction judging means judges that said canister is malfunctioning.

* * * * *